US009869510B2

(12) United States Patent
Cuellar et al.

(10) Patent No.: US 9,869,510 B2
(45) Date of Patent: Jan. 16, 2018

(54) LIQUEFIED NATURAL GAS PROCESSING

(75) Inventors: Kyle T. Cuellar, Katy, TX (US); John D. Wilkinson, Midland, TX (US); Hank M. Hudson, Midland, TX (US)

(73) Assignee: Ortloff Engineers, Ltd., Midland, TX (US)

( * ) Notice: Subject to any disclaimer, the term of this patent is extended or adjusted under 35 U.S.C. 154(b) by 1764 days.

(21) Appl. No.: 12/060,362

(22) Filed: Apr. 1, 2008

(65) Prior Publication Data

US 2008/0282731 A1 Nov. 20, 2008

Related U.S. Application Data

(60) Provisional application No. 60/938,489, filed on May 17, 2007.

(51) Int. Cl.

| | |
|---|---|
| ***F25J 3/00*** | (2006.01) |
| ***F25J 3/02*** | (2006.01) |
| ***C10L 3/10*** | (2006.01) |

(52) U.S. Cl.

CPC ..... *F25J 3/0233* (2013.01); *C10L 3/10* (2013.01); *F25J 3/0214* (2013.01); *F25J 3/0242* (2013.01);

(Continued)

(58) Field of Classification Search

CPC .. F25J 3/00; F25J 3/0233; F25J 3/0214; F25J 3/0242; F25J 2200/02; F25J 2200/74;

(Continued)

(56) References Cited

U.S. PATENT DOCUMENTS 2,603,310 A 7/1952 Gilmore
2,880,592 A 4/1959 Davison et al.

(Continued)

FOREIGN PATENT DOCUMENTS

FR 1535846 A 8/1968
GB 2102931 A 2/1983

(Continued)

OTHER PUBLICATIONS

PCT Notification of Transmittal of The International Search Report and The Written Opinion of The International Searching Authority, or The Declaration (Form PCT/ISA/220), PCT International Search Report (Form PCT/ISA/210) and PCT Written Opinion of the International Searching Authority (Form PCT/ISA/237) of International Application No. PCT/US 08/59712.

(Continued)

*Primary Examiner* — Frantz Jules
*Assistant Examiner* — Webeshet Mengesha
(74) *Attorney, Agent, or Firm* — Fitzpatrick, Cella, Harper & Scinto

(57) ABSTRACT

A process and apparatus for the recovery of heavier hydrocarbons from a liquefied natural gas (LNG) stream is disclosed. The LNG feed stream is heated to vaporize at least part of it, then supplied to a fractionation column at a mid-column feed position. A vapor distillation stream is withdrawn from the fractionation column below the mid-column feed position and directed in heat exchange relation with the LNG feed stream, cooling the vapor distillation stream as it supplies at least part of the heating of the LNG feed stream. The vapor distillation stream is cooled sufficiently to condense at least a part of it, forming a condensed stream. At least a portion of the condensed stream is directed to the fractionation column as its top feed. The quantities and temperatures of the feeds to the column are effective to maintain the column overhead temperature at a temperature whereby the major portion of the desired components is recovered in the bottom liquid product from the column.

25 Claims, 2 Drawing Sheets

Figure 1:
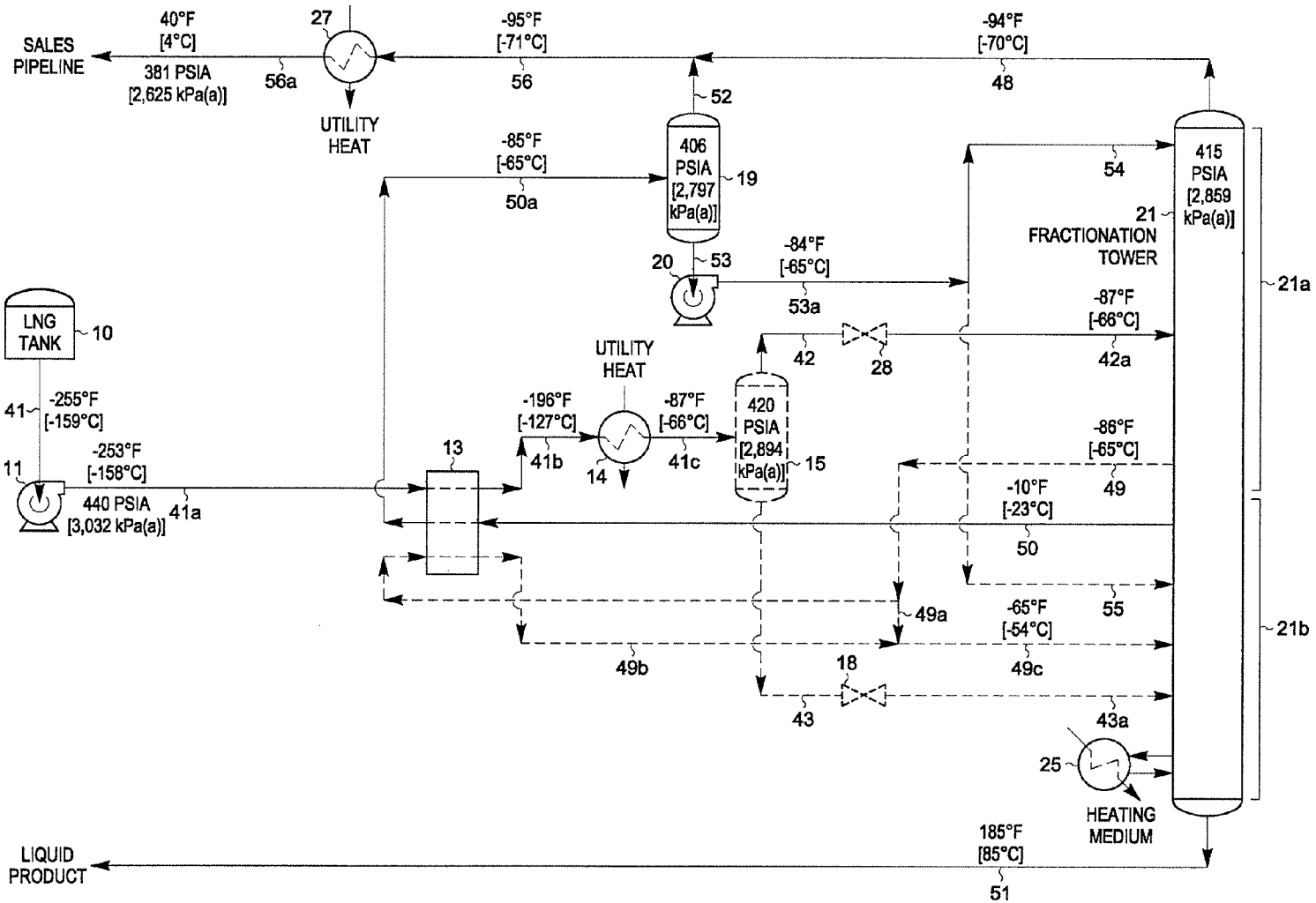

(52) U.S. Cl.
CPC ..... *F25J 2200/02* (2013.01); *F25J 2200/74* (2013.01); *F25J 2200/78* (2013.01); *F25J 2205/02* (2013.01); *F25J 2205/04* (2013.01); *F25J 2230/08* (2013.01); *F25J 2230/60* (2013.01); *F25J 2240/02* (2013.01); *F25J 2240/40* (2013.01)

(58) Field of Classification Search
CPC .. F25J 2240/40; F25J 2205/02; F25J 2205/04; F25J 2230/08; F25J 2230/60; F25J 2240/02; F25J 2200/78
USPC ..... 62/617–619, 620, 612, 613, 614
See application file for complete search history.

(56) References Cited

U.S. PATENT DOCUMENTS 2,925,984 A 2/1960 Kowalski
3,292,380 A 12/1966 Bucklin
3,524,897 A 8/1970 Kniel
3,724,226 A 4/1973 Pachaly
3,763,658 A 10/1973 Gaumer, Jr. et al.
3,837,172 A 9/1974 Markbreiter et al. ..... 62/24
4,033,735 A 7/1977 Swenson
4,061,481 A 12/1977 Campbell et al.
4,065,278 A 12/1977 Newton et al.
4,140,504 A 2/1979 Campbell et al.
4,157,904 A 6/1979 Campbell et al.
4,171,964 A 10/1979 Campbell et al.
4,185,978 A 1/1980 McGalliard et al.
4,251,249 A 2/1981 Gulsby
4,278,457 A 7/1981 Campbell et al.
4,368,061 A 1/1983 Mestrallet et al.
4,404,008 A 9/1983 Rentler et al.
4,430,103 A 2/1984 Gray et al.
4,445,916 A 5/1984 Newton
4,445,917 A 5/1984 Chiu
4,453,958 A 6/1984 Gulsby et al.
4,519,824 A 5/1985 Huebel
4,525,185 A 6/1985 Newton
4,545,795 A 10/1985 Liu et al.
4,559,070 A * 12/1985 Sweet ..... 62/625
4,592,766 A 6/1986 Kumman et al.
4,596,588 A 6/1986 Cook
4,600,421 A 7/1986 Kummann
4,617,039 A 10/1986 Buck
4,657,571 A 4/1987 Gazzi
4,676,812 A 6/1987 Kummann
4,687,499 A 8/1987 Aghili
4,689,063 A 8/1987 Paradowski et al.
4,690,702 A 9/1987 Paradowski et al.
4,698,081 A 10/1987 Aghili
4,707,170 A 11/1987 Ayres et al.
4,710,214 A 12/1987 Sharma et al.
4,711,651 A 12/1987 Sharma et al.
4,718,927 A 1/1988 Bauer et al.
4,720,294 A 1/1988 Lucadamo et al.
4,738,699 A 4/1988 Apffel
4,752,312 A 6/1988 Prible
4,755,200 A 7/1988 Liu et al.
4,793,841 A 12/1988 Burr
4,851,020 A 7/1989 Montgomery, IV
4,854,955 A 8/1989 Campbell et al.
4,869,740 A 9/1989 Campbell et al.
4,881,960 A 11/1989 Ranke et al.
4,889,545 A 12/1989 Campbell et al.
4,895,584 A 1/1990 Buck et al.
RE33,408 E 10/1990 Khan et al.
4,970,867 A 11/1990 Herron et al.
5,114,451 A 5/1992 Rambo et al. ..... 62/24
5,114,541 A 5/1992 Bayer
5,275,005 A 1/1994 Campbell et al.
5,291,736 A 3/1994 Paradowski
5,325,673 A 7/1994 Durr et al.
5,363,655 A 11/1994 Kikkawa et al.
5,365,740 A 11/1994 Kikkawa et al.
5,421,165 A 6/1995 Paradowski et al.
5,537,827 A 7/1996 Low et al.
5,555,748 A 9/1996 Campbell et al.
5,566,554 A 10/1996 Vijayaraghavan et al.
5,568,737 A 10/1996 Campbell et al.
5,600,969 A 2/1997 Low
5,615,561 A 4/1997 Houshmand et al.
5,651,269 A 7/1997 Prevost et al.
5,669,234 A 9/1997 Houser et al.
5,737,940 A 4/1998 Yao et al.
5,755,114 A 5/1998 Foglietta
5,755,115 A 5/1998 Manley
5,771,712 A 6/1998 Campbell et al.
5,799,507 A * 9/1998 Wilkinson et al. ..... 62/621
5,881,569 A 3/1999 Campbell et al.
5,890,378 A 4/1999 Rambo et al.
5,893,274 A 4/1999 Nagelvoort et al.
5,950,453 A 9/1999 Bowen et al.
5,983,664 A 11/1999 Campbell et al.
6,014,869 A 1/2000 Elion et al.
6,016,665 A 1/2000 Cole et al.
6,023,942 A 2/2000 Thomas et al.
6,053,007 A 4/2000 Victory et al.
6,062,041 A 5/2000 Kikkawa et al.
6,116,050 A 9/2000 Yao et al.
6,119,479 A 9/2000 Roberts et al.
6,125,653 A 10/2000 Shu et al.
6,182,469 B1 2/2001 Campbell et al.
6,250,105 B1 6/2001 Kimble
6,269,655 B1 8/2001 Roberts et al.
6,272,882 B1 8/2001 Hodges et al.
6,308,531 B1 10/2001 Roberts et al.
6,324,867 B1 12/2001 Fanning et al.
6,336,344 B1 1/2002 O'Brien
6,347,532 B1 2/2002 Agrawal et al.
6,363,744 B2 4/2002 Finn et al.
6,367,286 B1 4/2002 Price
6,401,486 B1 6/2002 Lee et al.
6,526,777 B1 3/2003 Campbell et al.
6,564,579 B1 5/2003 McCartney
6,604,380 B1 8/2003 Reddick et al.
6,742,358 B2 6/2004 Wilkinson et al.
6,889,523 B2 5/2005 Wilkinson et al.
6,907,752 B2 6/2005 Schroeder et al.
6,941,771 B2 9/2005 Reddick et al.
6,986,266 B2 1/2006 Narinsky
7,069,743 B2 7/2006 Prim ..... 62/620
7,155,931 B2 1/2007 Wilkinson et al. ..... 62/620
7,216,507 B2 5/2007 Cuellar et al. ..... 62/620
7,278,281 B2 10/2007 Yang et al.
7,631,516 B2 12/2009 Cuellar et al.
2004/0079107 A1 4/2004 Wilkinson et al.
2005/0066686 A1 3/2005 Wilkinson et al.
2005/0247078 A1* 11/2005 Wilkinson et al. ..... 62/612
2005/0268649 A1* 12/2005 Wilkinson et al. ..... 62/613
2006/0000234 A1 1/2006 Cuellar et al. ..... 62/620
2006/0032269 A1* 2/2006 Cuellar ..... F25J 3/0209 62/620
2006/0130521 A1* 6/2006 Patel ..... 62/620
2006/0260355 A1 11/2006 Roberts et al. ..... 62/620
2006/0260356 A1 11/2006 Schroeder et al. ..... 62/620
2006/0277943 A1 12/2006 Yokohata et al. ..... 62/620
2006/0283207 A1* 12/2006 Pitman et al. ..... 62/620
2007/0001322 A1 1/2007 Aikhorin et al. ..... 261/75

FOREIGN PATENT DOCUMENTS

SU 1606828 A1 10/1986
WO 01/88447 A1 11/2001
WO 2004/109180 A1 12/2004
WO 2005/015100 A1 2/2005
WO 2005/035692 A2 4/2005

OTHER PUBLICATIONS

Huang et al., "Select the Optimum Extraction Method for LNG Regasification; Varying Energy Compositions of LNG Imports may

(56) References Cited

OTHER PUBLICATIONS

Require Terminal Operators to Remove $C_2$+ Compounds before Injecting Regasified LNG into Pipelines", Hydrocarbon ProcessinJL 83, 57-62, Jul. 2004.
Yang et al., "Cost-Effective Design Reduces C2 and C3 at LNG Receiving Terminals", Oil & Gas Journal, 50-53, May 26, 2003.
B.C. Price et al., "LNG Production for Peak Shaving Operations", Proceedings of the Seventy-eighth Annual Convention of the Gas Processors Association, Nashville, Tennessee, Mar. 1-3, 1999, 8 sheets.
Finn et al., "LNG Technology for Offshore and Mid-scale Plants", Proceedings of the Seventy-ninth Annual Convention of the Gas Processors Association, Atlanta, Georgia, Mar. 13-15, 2003, 23 sheets.
Kikkawa et al., "Optimize The Power System of Baseload LNG Plant", Proceedings of the Eightieth Annual Convention of The Gas Processors Association, San Antonio, Texas, Mar. 12-14, 2001, 23 sheets.

* cited by examiner

LIQUEFIED NATURAL GAS PROCESSING

The applicants claim the benefits under Title 35, United States Code, Section 119(e) of prior U.S. Provisional Application No. 60/938,489 which was filed on May 17, 2007.

BACKGROUND OF THE INVENTION

This invention relates to a process for the separation of ethane and heavier hydrocarbons or propane and heavier hydrocarbons from liquefied natural gas, hereinafter referred to as LNG, to provide a volatile methane-rich gas stream and a less volatile natural gas liquids (NGL) or liquefied petroleum gas (LPG) stream.

As an alternative to transportation in pipelines, natural gas at remote locations is sometimes liquefied and transported in special LNG tankers to appropriate LNG receiving and storage terminals. The LNG can then be re-vaporized and used as a gaseous fuel in the same fashion as natural gas. Although LNG usually has a major proportion of methane, i.e., methane comprises at least 50 mole percent of the LNG, it also contains relatively lesser amounts of heavier hydrocarbons such as ethane, propane, butanes, and the like, as well as nitrogen. It is often necessary to separate some or all of the heavier hydrocarbons from the methane in the LNG so that the gaseous fuel resulting from vaporizing the LNG conforms to pipeline specifications for heating value. In addition, it is often also desirable to separate the heavier hydrocarbons from the methane and ethane because these hydrocarbons have a higher value as liquid products (for use as petrochemical feedstocks, as an example) than their value as fuel.

Although there are many processes which may be used to separate ethane and/or propane and heavier hydrocarbons from LNG, these processes often must compromise between high recovery, low utility costs, and process simplicity (and hence low capital investment). U.S. Pat. Nos. 2,952,984; 3,837,172; 5,114,451; and 7,155,931 describe relevant LNG processes capable of ethane or propane recovery while producing the lean LNG as a vapor stream that is thereafter compressed to delivery pressure to enter a gas distribution network. However, lower utility costs may be possible if the lean LNG is instead produced as a liquid stream that can be pumped (rather than compressed) to the delivery pressure of the gas distribution network, with the lean LNG subsequently vaporized using a low level source of external heat or other means. U.S. Pat. Nos. 7,069,743 and 7,216,507 and co-pending application Ser. No. 11/749,268 describe such processes.

The present invention is generally concerned with the recovery of propylene, propane, and heavier hydrocarbons from such LNG streams. It uses a novel process arrangement to allow high propane recovery while keeping the processing equipment simple and the capital investment low. Further, the present invention offers a reduction in the utilities (power and heat) required to process the LNG to give lower operating cost than the prior art processes, and also offers significant reduction in capital investment. A typical analysis of an LNG stream to be processed in accordance with this invention would be, in approximate mole percent, 86.7% methane, 8.9% ethane and other $C_2$ components, 2.9% propane and other $C_3$ components, and 1.0% butanes plus, with the balance made up of nitrogen.

Figure 2:
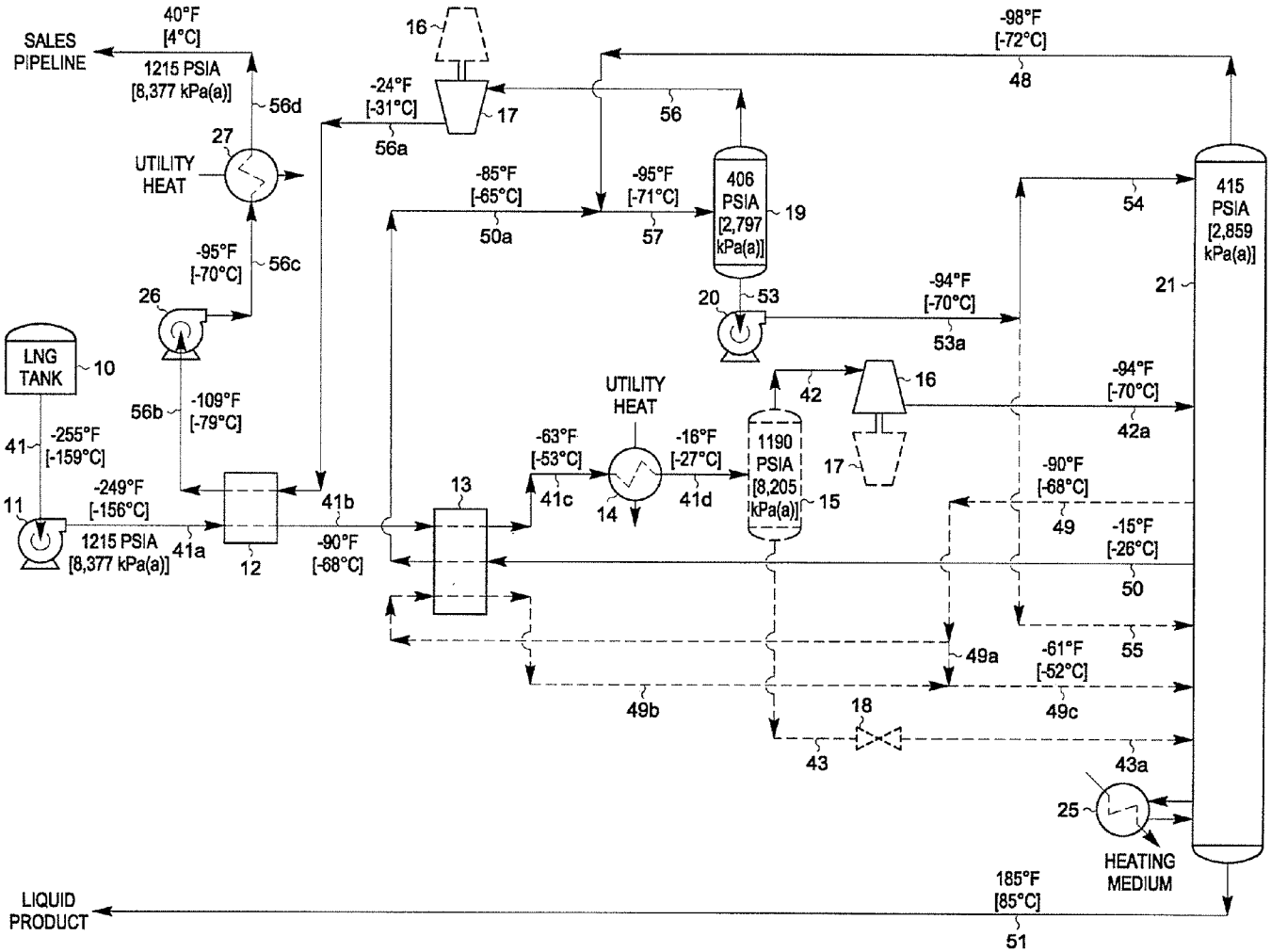

For a better understanding of the present invention, reference is made to the following examples and drawings. Referring to the drawings:

FIG. 1 is a flow diagram of an LNG processing plant in accordance with the present invention where the vaporized LNG product is to be delivered at a relatively low pressure; and FIG. 2 is a flow diagram illustrating an alternative means of application of the present invention to an LNG processing plant where the vaporized LNG product must be delivered at relatively higher pressure.

In the following explanation of the above figures, tables are provided summarizing flow rates calculated for representative process conditions. In the tables appearing herein, the values for flow rates (in moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

For convenience, process parameters are reported in both the traditional British units and in the units of the Système International d'Unités (SI). The molar flow rates given in the tables may be interpreted as either pound moles per hour or kilogram moles per hour. The energy consumptions reported as horsepower (HP) and/or thousand British Thermal Units per hour (MBTU/Hr) correspond to the stated molar flow rates in pound moles per hour. The energy consumptions reported as kilowatts (kW) correspond to the stated molar flow rates in kilogram moles per hour.

DESCRIPTION OF THE INVENTION

Example 1

FIG. 1 illustrates a flow diagram of a process in accordance with the present invention adapted to produce an LPG product containing the majority of the $C_3$ components and heavier hydrocarbon components present in the feed stream.

In the simulation of the FIG. 1 process, the LNG to be processed (stream 41) from LNG tank 10 enters pump 11 at −255° F. [−159° C.], which elevates the pressure of the LNG sufficiently so that it can flow through heat exchangers 13 and 14 and thence to fractionation column 21. Stream 41*a* exiting the pump at −253° F. [−158° C.] and 440 psia [3,032 kPa(a)] is heated to −196° F. [−127° C.] (stream 41*b*) in heat exchanger 13 by cooling and partially condensing distillation vapor stream 50 which has been withdrawn from a mid-column region of fractionation tower 21. The heated stream 41*b* is then further heated to −87° F. [−66° C.] in heat exchanger 14 using low level utility heat. (High level utility heat, such as the heating medium used in tower reboiler 25, is normally more expensive than low level utility heat, so lower operating cost is usually achieved when use of low level heat, such as sea water, is maximized and the use of high level utility heat is minimized.) The further heated stream 41*c*, now partially vaporized, is then supplied to fractionation column 21 at an upper mid-column feed point. Under some circumstances, it may be desirable to separate stream 41*c* into vapor stream 42 and liquid stream 43 via separator 15 and route each stream separately to fractionation column 21 as indicated by the dashed lines in FIG. 1.

The deethanizer in tower 21 is a conventional distillation column containing a plurality of vertically spaced trays, one or more packed beds, or some combination of trays and packing. The deethanizer tower consists of two sections: an upper absorbing (rectification) section 21*a* that contains the necessary trays or packing to provide the necessary contact between the vapor portion of stream 41*c* rising upward and cold liquid falling downward to condense and absorb propane and heavier components from the vapor portion; and a lower, stripping section 21*b* that contains the trays and/or packing to provide the necessary contact between the liquids falling downward and the vapors rising upward. The deethanizer stripping section 21*b* also includes one or more reboilers (such as reboiler 25) which heat and vaporize a portion of the liquid at the bottom of the column to provide the stripping vapors which flow up the column. These vapors strip the methane and $C_2$ components from the liquids, so that the bottom liquid product (stream 51) is substantially devoid of methane and $C_2$ components and is comprised of the majority of the $C_3$ components and heavier hydrocarbons contained in the LNG feed stream.

Stream 41*c* enters fractionation column 21 at an upper mid-column feed position located in the lower region of absorbing section 21*a* of fractionation column 21. The liquid portion of stream 41*c* comingles with the liquids falling downward from the absorbing section and the combined liquid proceeds downward into stripping section 21*b* of deethanizer 21. The vapor portion of stream 41*c* rises upward through absorbing section 21*a* and is contacted with cold liquid falling downward to condense and absorb the $C_3$ components and heavier components.

A liquid stream 49 from deethanizer 21 is withdrawn from the lower region of absorbing section 21*a* and is routed to heat exchanger 13 where it is heated as it provides cooling of distillation vapor stream 50 as described earlier. Typically, the flow of this liquid from the deethanizer is via a thermosiphon circulation, but a pump could be used. The liquid stream is heated from −86° F. [−65° C.] to −65° F. [−54° C.], partially vaporizing stream 49*c* before it is returned as a mid-column feed to deethanizer 21, typically in the middle region of stripping section 21*b*. Alternatively, the liquid stream 49 may be routed directly without heating to the lower mid-column feed point in the stripping section 21*b* of deethanizer 21 as shown by dashed line 49*a*.

A portion of the distillation vapor (stream 50) is withdrawn from the upper region of stripping section 21*b* at −10° F. [−23° C.]. This stream is then cooled and partially condensed (stream 50*a*) in exchanger 13 by heat exchange with LNG stream 41*a* and liquid stream 49 (if applicable) as described previously. The partially condensed stream 50*a* then flows to reflux separator 19 at −85° F. [−65° C.].

The operating pressure in reflux separator 19 (406 psia [2,797 kPa(a)]) is maintained slightly below the operating pressure of deethanizer 21 (415 psia [2,859 kPa(a)]). This provides the driving force which causes distillation vapor stream 50 to flow through heat exchanger 13 and thence into reflux separator 19 wherein the condensed liquid (stream 53) is separated from any uncondensed vapor (stream 52). Stream 52 then combines with the deethanizer overhead stream 48 to form cold residue gas stream 56 at −95° F. [−71° C.], which is then heated to 40° F. [4° C.] using low level utility heat in heat exchanger 27 before flowing to the sales gas pipeline at 381 psia [2,625 kPa(a)].

The liquid stream 53 from reflux separator 19 is pumped by pump 20 to a pressure slightly above the operating pressure of deethanizer 21, and the pumped stream 53*a* is then divided into at least two portions. One portion, stream 54, is supplied as top column feed (reflux) to deethanizer 21. This cold liquid reflux absorbs and condenses the $C_3$ components and heavier components rising in the upper rectification region of absorbing section 21*a* of deethanizer 21. The other portion, stream 55, is supplied to deethanizer 21 at a mid-column feed position located in the upper region of stripping section 21*b*, in substantially the same region where distillation vapor stream 50 is withdrawn, to provide partial rectification of stream 50.

The deethanizer overhead vapor (stream 48) exits the top of deethanizer 21 at −94° F. [−70° C.] and is combined with vapor stream 52 as described previously. The liquid product stream 51 exits the bottom of the tower at 185° F. [85° C.] based on an ethane:propane ratio of 0.02:1 on a molar basis in the bottom product, and flows to storage or further processing.

A summary of stream flow rates and energy consumption for the process illustrated in FIG. 1 is set forth in the following table:

TABLE I (FIG. 1)
Stream Flow Summary - Lb. Moles/Hr [kg moles/Hr]

| Stream | Methane | Ethane | Propane | Butanes+ | Total |
|---|---|---|---|---|---|
| 41 | 17,281 | 1,773 | 584 | 197 | 19,923 |
| 49 | 1,468 | 1,154 | 583 | 197 | 3,403 |
| 50 | 2,409 | 2,456 | 4 | 0 | 4,871 |
| 53 | 1,790 | 2,371 | 4 | 0 | 4,165 |
| 54 | 626 | 830 | 1 | 0 | 1,457 |
| 55 | 1,164 | 1,541 | 3 | 0 | 2,708 |
| 52 | 619 | 85 | 0 | 0 | 706 |
| 48 | 16,662 | 1,677 | 2 | 0 | 18,426 |
| 56 | 17,281 | 1,762 | 2 | 0 | 19,132 |
| 51 | 0 | 11 | 582 | 197 | 791 |

Recoveries*

| | |
|---|---|
| Propane | 99.67% |
| Butanes+ | 100.00% |

Power

| | | |
|---|---|---|
| Liquid Feed Pump | 459 HP | [755 kW] |
| Reflux Pump | 21 HP | [35 kW] |
| Totals | 480 HP | [790 kW] |

Low Level Utility Heat

| | | |
|---|---|---|
| Liquid Feed Heater | 71,532 MBTU/Hr | [46,206 kW] |
| Residue Gas Heater | 27,084 MBTU/Hr | [17,495 kW] |
| Totals | 98,616 MBTU/Hr | [63,701 kW] |

High Level Utility Heat

| | | |
|---|---|---|
| Deethanizer Reboiler | 26,816 MBTU/Hr | [17,322 kW] |

*(Based on un-rounded flow rates)

There are three primary factors that account for the improved efficiency of the present invention. First, compared to many prior art processes, the present invention does not depend on the LNG feed itself to directly serve as the reflux for fractionation column 21. Rather, the refrigeration inherent in the cold LNG is used in heat exchanger 13 to generate a liquid reflux stream (stream 54) that contains very little of the $C_3$ components and heavier hydrocarbon components that are to be recovered, resulting in efficient rectification in absorbing section 21*a* of fractionation tower 21 and avoiding the equilibrium limitations of such prior art processes. Second, the partial rectification of distillation vapor stream 50 by reflux stream 55 results in a top reflux stream 54 that is predominantly liquid methane and $C_2$ components and contains very little $C_3$ components and heavier hydrocarbon components. As a result, nearly 100% of the $C_3$ components and substantially all of the heavier hydrocarbon components are recovered in liquid product 51 leaving the bottom of deethanizer 21. Third, the rectification of the column vapors provided by absorbing section 21*a* allows the majority of the LNG feed to be vaporized before entering deethanizer 21 as stream 41*c* (with much of the vaporization duty provided by low level utility heat in heat exchanger 14). With less total liquid feeding fractionation column 21, the high level utility heat consumed by reboiler 25 to meet the specification for the bottom liquid product from the deethanizer is minimized.

Example 2

FIG. 1 represents the preferred embodiment of the present invention when the required delivery pressure of the vaporized LNG residue gas is relatively low. An alternative method of processing the LNG stream to deliver the residue gas at relatively high pressure is shown in another embodiment of the present invention as illustrated in FIG. 2. The LNG feed composition and conditions considered in the process presented in FIG. 2 are the same as those for FIG. 1. Accordingly, the FIG. 2 process of the present invention can be compared to the embodiment of FIG. 1.

In the simulation of the FIG. 2 process, the LNG to be processed (stream 41) from LNG tank 10 enters pump 11 at −255° F. [−159° C.] to elevate the pressure of the LNG to 1215 psia [8,377 kPa(a)]. The high pressure LNG (stream 41*a*) then flows through heat exchanger 12 where it is heated from −249° F. [−156° C.] to −90° F. [−68° C.] (stream 41*b*) by heat exchange with vapor stream 56*a* from booster compressor 17. Heated stream 41*b* then flows through heat exchanger 13 where it is heated to −63° F. [−53° C.] (stream 41*c*) by cooling and partially condensing distillation vapor stream 50 which has been withdrawn from a mid-column region of fractionation tower 21. Stream 41*c* is then further heated to −16° F. [−27° C.] in heat exchanger 14 using low level utility heat.

The further heated stream 41*d* is then supplied to expansion machine 16 in which mechanical energy is extracted from the high pressure feed. The machine 16 expands the vapor substantially isentropically from a pressure of about 1190 psia [8,205 kPa(a)] to a pressure of about 415 psia [2,859 kPa(a)] (the operating pressure of fractionation column 21). The work expansion cools the expanded stream 42*a* to a temperature of approximately −94° F. [−70° C.]. The typical commercially available expanders are capable of recovering on the order of 80-88% of the work theoretically available in an ideal isentropic expansion. The work recovered is often used to drive a centrifugal compressor (such as item 17) that can be used to re-compress the cold vapor stream (stream 56), for example. The expanded and partially condensed stream 42*a* is thereafter supplied to fractionation column 21 at an upper mid-column feed point.

For the composition and conditions illustrated in FIG. 2, stream 41*d* is heated sufficiently to be in a completely vapor state. Under some circumstances, it may be desirable to partially vaporize stream 41*d* and then separate it into vapor stream 42 and liquid stream 43 via separator 15 as indicated by the dashed lines in FIG. 2. In such an instance, vapor stream 42 would enter expansion machine 16, while liquid stream 43 would enter expansion valve 18 and the expanded liquid stream 43*a* would be supplied to fractionation column 21 at a lower mid-column feed point.

Expanded stream 42*a* enters fractionation column 21 at an upper mid-column feed position located in the lower region of the absorbing section of fractionation column 21. The liquid portion of stream 42*a* comingles with the liquids falling downward from the absorbing section and the combined liquid proceeds downward into the stripping section of deethanizer 21. The vapor portion of expanded stream 42*a* rises upward through the absorbing section and is contacted with cold liquid falling downward to condense and absorb the $C_3$ components and heavier components.

A liquid stream 49 from deethanizer 21 is withdrawn from the lower region of the absorbing section and is routed to heat exchanger 13 where it is heated as it provides cooling of distillation vapor stream 50 as described earlier. The liquid stream is heated from −90° F. [−68° C.] to −61° F. [−52° C.], partially vaporizing stream 49*c* before it is returned as a mid-column feed to deethanizer 21, typically in the middle region of the stripping section. Alternatively, the liquid stream 49 may be routed directly without heating to the lower mid-column feed point in the stripping section of deethanizer 21 as shown by dashed line 49*a*.

A portion of the distillation vapor (stream 50) is withdrawn from the upper region of the stripping section at −15° F. [−26° C.]. This stream is then cooled and partially condensed (stream 50*a*) in exchanger 13 by heat exchange with LNG stream 41*b* and liquid stream 49 (if applicable). The partially condensed stream 50*a* at −85° F. [−65° C.] then combines with overhead vapor stream 48 from deethanizer 21 and the combined stream 57 flows to reflux separator 19 at −95° F. [−71° C.]. (It should be noted that the combining of streams 50*a* and 48 can occur in the piping upstream of reflux separator 19 as shown in FIG. 2, or alternatively, streams 50*a* and 48 can flow individually to reflux separator 19 with the commingling of the streams occurring therein.

The operating pressure of reflux separator 19 (406 psia [2,797 kPa(a)]) is maintained slightly below the operating pressure of deethanizer 21. This provides the driving force which causes distillation vapor stream 50 to flow through heat exchanger 13, combine with column overhead vapor stream 48 if appropriate, and thence flow into reflux separator 19 wherein the condensed liquid (stream 53) is separated from any uncondensed vapor (stream 56).

The liquid stream 53 from reflux separator 19 is pumped by pump 20 to a pressure slightly above the operating pressure of deethanizer 21, and the pumped stream 53*a* is then divided into at least two portions. One portion, stream 54, is supplied as top column feed (reflux) to deethanizer 21. This cold liquid reflux absorbs and condenses the $C_3$ components and heavier components rising in the upper rectification region of the absorbing section of deethanizer 21. The other portion, stream 55, is supplied to deethanizer 21 at a mid-column feed position located in the upper region of the stripping section in substantially the same region where distillation vapor stream 50 is withdrawn, to provide partial rectification of stream 50. The deethanizer overhead vapor (stream 48) exits the top of deethanizer 21 at −98° F. [−72° C.] and is combined with partially condensed stream 50*a* as described previously. The liquid product stream 51 exits the bottom of the tower at 185° F. [85° C.] and flows to storage or further processing.

The cold vapor stream 56 from separator 19 flows to compressor 17 driven by expansion machine 16 to increase the pressure of stream 56*a* sufficiently so that it can be totally condensed in heat exchanger 12. Stream 56*a* exits the compressor at −24° F. [−31° C.] and 718 psia [4,953 kPa(a)] and is cooled to −109° F. [−79° C.] (stream 56*b*) by heat exchange with the high pressure LNG feed stream 41*a* as discussed previously. Condensed stream 56*b* is pumped by pump 26 to a pressure slightly above the sales gas delivery pressure. Pumped stream 56*c* is then heated from −95° F. [−70° C.] to 40° F. [4° C.] in heat exchanger 27 before flowing to the sales gas pipeline at 1215 psia [8,377 kPa(a)] as residue gas stream 56*d*.

A summary of stream flow rates and energy consumption for the process illustrated in FIG. 2 is set forth in the following table:

TABLE II (FIG. 2)
Stream Flow Summary - Lb. Moles/Hr [kg moles/Hr]

| Stream | Methane | Ethane | Propane | Butanes+ | Total |
|---|---|---|---|---|---|
| 41 | 17,281 | 1,773 | 584 | 197 | 19,923 |
| 49 | 1,800 | 1,386 | 584 | 197 | 3,969 |
| 50 | 2,585 | 2,278 | 5 | 0 | 4,871 |
| 53 | 1,927 | 2,027 | 6 | 0 | 3,962 |
| 54 | 674 | 709 | 2 | 0 | 1,387 |
| 55 | 1,253 | 1,318 | 4 | 0 | 2,575 |
| 48 | 16,623 | 1,510 | 2 | 0 | 18,222 |
| 56 | 17,281 | 1,761 | 1 | 0 | 19,131 |
| 51 | 0 | 12 | 583 | 197 | 792 |

Recoveries*

| | |
|---|---|
| Propane | 99.84% |
| Butanes+ | 100.00% |

Power

| | | |
|---|---|---|
| Liquid Feed Pump | 1,409 HP | [2,316 kW] |
| Reflux Pump | 20 HP | [33 kW] |
| LNG Product Pump | 1,024 HP | [1,684 kW] |
| Totals | 2,453 HP | [4,033 kW] |

Low Level Utility Heat

| | | |
|---|---|---|
| Liquid Feed Heater | 27,261 MBTU/Hr | [17,609 kW] |
| Residue Gas Heater | 54,840 MBTU/Hr | [35,424 kW] |
| Totals | 82,101 MBTU/Hr | [53,033 kW] |

High Level Utility Heat

| | | |
|---|---|---|
| Demethanizer Reboiler | 26,808 MBTU/Hr | [17,316 kW] |

*(Based on un-rounded flow rates)

A comparison of Tables I and II shows that both the FIG. 1 and FIG. 2 embodiments achieve comparable recovery of $C_3$ and heavier components. Although the FIG. 2 embodiment requires considerably more pumping power than the FIG. 1 embodiment, this is a result of the much higher sales gas delivery pressure for the process conditions shown in FIG. 2. Nonetheless, the power required for the FIG. 2 embodiment of the present invention is less than that of prior art processes operating under the same conditions.

Other Embodiments

In accordance with this invention, it is generally advantageous to design the absorbing (rectification) section of the deethanizer to contain multiple theoretical separation stages. However, the benefits of the present invention can be achieved with as few as one theoretical stage, and it is believed that even the equivalent of a fractional theoretical stage may allow achieving these benefits. For instance, all or a part of the condensed liquid (stream 53) leaving reflux separator 19 and all or a part of stream 42*a* can be combined (such as in the piping to the deethanizer) and if thoroughly intermingled, the vapors and liquids will mix together and separate in accordance with the relative volatilities of the various components of the total combined streams. Such commingling of the two streams shall be considered for the purposes of this invention as constituting an absorbing section.

As described earlier, the distillation vapor stream 50 is partially condensed and the resulting condensate used to absorb valuable $C_3$ components and heavier components from the vapors in stream 42*a*. However, the present invention is not limited to this embodiment. It may be advantageous, for instance, to treat only a portion of these vapors in this manner, or to use only a portion of the condensate as an absorbent, in cases where other design considerations indicate portions of the vapors or the condensate should bypass the absorbing section of the deethanizer. LNG conditions, plant size, available equipment, or other factors may indicate that elimination of work expansion machine 16 in FIG. 2, or replacement with an alternate expansion device (such as an expansion valve), is feasible, or that total (rather than partial) condensation of distillation vapor stream 50 in heat exchanger 13 is possible or is preferred.

In the practice of the present invention, there will necessarily be a slight pressure difference between deethanizer 21 and reflux separator 19 which must be taken into account. If the distillation vapor stream 50 passes through heat exchanger 13 and into reflux separator 19 without any boost in pressure, reflux separator 19 shall necessarily assume an operating pressure slightly below the operating pressure of deethanizer 21. In this case, the liquid stream withdrawn from reflux separator 19 can be pumped to its feed position (s) on deethanizer 21. An alternative is to provide a booster blower for distillation vapor stream 50 to raise the operating pressure in heat exchanger 13 and reflux separator 19 sufficiently so that the liquid stream 53 can be supplied to deethanizer 21 without pumping.

Some circumstances may favor pumping the LNG stream to a higher pressure than that shown in FIG. 1 even when the delivery pressure of the residue gas is low. In such instances, an expansion device such as expansion valve 28 or an expansion engine may be used to reduce the pressure of stream 41*c* to that of fractionation column 21. If separator 15 is used, then an expansion device such as expansion valve 18 would also be required to reduce the pressure of separator liquid stream 43 to that of column 21. If an expansion engine is used in lieu of expansion valve 28 and/or 18, the work expansion could be used to drive a generator, which could in turn be used to reduce the amount of external pumping power required by the process. Similarly, the expansion engine 16 in FIG. 2 could also be used to drive a generator, in which case compressor 17 could be driven by an electric motor.

In some circumstance it may be desirable to bypass some or all of liquid stream 49 around heat exchanger 13. If a partial bypass is desirable, the bypass stream 49*a* would then be mixed with the outlet stream 49*b* from exchanger 13 and the combined stream 49*c* returned to the stripping section of fractionation column 21. The use and distribution of the liquid stream 49 for process heat exchange, the particular arrangement of heat exchangers for LNG stream heating and distillation vapor stream cooling, and the choice of process streams for specific heat exchange services must be evaluated for each particular application.

It will also be recognized that the relative amount of feed found in each branch of the condensed liquid contained in stream 53*a* that is split between the two column feeds in FIGS. 1 and 2 will depend on several factors, including LNG pressure, LNG stream composition, and the desired recovery levels. The optimum split cannot generally be predicted without evaluating the particular circumstances for a specific application of the present invention. It may be desirable in some cases to route all the reflux stream 53*a* to the top of the absorbing section in deethanizer 21 with no flow in dashed line 55 in FIGS. 1 and 2. In such cases, the quantity of liquid stream 49 withdrawn from fractionation column 21 could be reduced or eliminated.

The mid-column feed positions depicted in FIGS. 1 and 2 are the preferred feed locations for the process operating conditions described. However, the relative locations of the mid-column feeds may vary depending on the LNG composition or other factors such as desired recovery levels, etc. Moreover, two or more of the feed streams, or portions thereof, may be combined depending on the relative temperatures and quantities of individual streams, and the combined stream then fed to a mid-column feed position. FIGS. 1 and 2 are the preferred embodiments for the compositions and pressure conditions shown. Although individual stream expansion is depicted in particular expansion devices, alternative expansion means may be employed where appropriate. For example, conditions may warrant work expansion of the liquid stream (stream 43).

In FIGS. 1 and 2, multiple heat exchanger services have been shown combined in a common heat exchanger 13. It may be desirable in some instances to use individual heat exchangers for each service. In some cases, circumstances may favor splitting a heat exchange service into multiple exchangers. (The decision as to whether to combine heat exchange services or to use more than one heat exchanger for the indicated service will depend on a number of factors including, but not limited to, LNG flow rate, heat exchanger size, stream temperatures, etc.) Alternatively, heat exchanger 13 could be replaced by other heating means, such as a heater using sea water, a heater using a utility stream rather than a process stream (like stream 50 used in FIGS. 1 and 2), an indirect fired heater, or a heater using a heat transfer fluid warmed by ambient air, as warranted by the particular circumstances.

The present invention provides improved recovery of $C_3$ components per amount of utility consumption required to operate the process. It also provides for reduced capital expenditure in that all fractionation can be done in a single column. An improvement in utility consumption required for operating the deethanizer process may appear in the form of reduced power requirements for compression or re-compression, reduced power requirements for pumping, reduced energy requirements for tower reboilers, or a combination thereof. Alternatively, if desired, increased $C_3$ component recovery can be obtained for a fixed utility consumption.

In the examples given for the FIG. 1 and FIG. 2 embodiments, recovery of $C_3$ components and heavier hydrocarbon components is illustrated. However, it is believed that the embodiments may also be advantageous when recovery of $C_2$ components and heavier hydrocarbon components is desired.

While there have been described what are believed to be preferred embodiments of the invention, those skilled in the art will recognize that other and further modifications may be made thereto, e.g. to adapt the invention to various conditions, types of feed, or other requirements without departing from the spirit of the present invention as defined by the following claims.

We claim:

1. A process for the separation of liquefied natural gas containing methane, $C_2$ components, and heavier hydrocarbon components into a volatile vapor fraction containing a major portion of said methane and a major portion of said $C_2$ components and a relatively less volatile liquid fraction containing any remaining $C_2$ components and a major portion of said heavier hydrocarbon components wherein (a) said liquefied natural gas is heated sufficiently to at least partially vaporize said liquefied natural gas, thereby forming a vapor-containing stream;

(b) said vapor-containing stream is undivided and is supplied to a fractionation column at a mid-column feed position wherein said vapor-containing stream is fractionated into an overhead vapor stream and said relatively less volatile fraction containing the major portion of said heavier hydrocarbon components;

(c) a vapor distillation stream is withdrawn from a region of said fractionation column below said vapor-containing stream and, in the absence of further compression, is cooled sufficiently to at least partially condense said vapor distillation stream, forming thereby a condensed stream and any residual vapor stream, with said cooling supplying at least a portion of said heating of said liquefied natural gas;

(d) at least a portion of said condensed stream is supplied to said fractionation column at a top column feed position;

(e) at least a portion of said overhead vapor stream and said residual vapor stream are discharged as said volatile vapor fraction containing a major portion of said methane and a major portion of said $C_2$ components; and (f) the quantities and temperatures of said feeds to said fractionation column are effective to maintain the overhead temperature of said fractionation column at a temperature whereby the major portion of said heavier hydrocarbon components is recovered in said relatively less volatile liquid fraction.

2. A process for the separation of liquefied natural gas containing methane, $C_2$ components, and heavier hydrocarbon components into a volatile vapor fraction containing a major portion of said methane and a major portion of said $C_2$ components and a relatively less volatile liquid fraction containing any remaining $C_2$ components and a major portion of said heavier hydrocarbon components wherein (a) said liquefied natural gas is heated sufficiently to at least partially vaporize said liquefied natural gas, thereby forming a vapor stream and a liquid stream;

(b) said vapor stream, which is undivided, and said liquid stream are supplied to a fractionation column at upper and lower mid-column feed positions, respectively, wherein said vapor stream and said liquid stream are fractionated into an overhead vapor stream and said relatively less volatile fraction containing the major portion of said heavier hydrocarbon components;

(c) a vapor distillation stream is withdrawn from a region of said fractionation column below said vapor stream and, in the absence of further compression, is cooled sufficiently to at least partially condense said vapor distillation stream, forming thereby a condensed stream and any residual vapor stream, with said cooling supplying at least a portion of said heating of said liquefied natural gas;

(d) at least a portion of said condensed stream is supplied to said fractionation column at a top column feed position;

(e) at least a portion of said overhead vapor stream and said residual vapor stream are discharged as said volatile vapor fraction containing a major portion of said methane and a major portion of said $C_2$ components; and (f) the quantities and temperatures of said feeds to said fractionation column are effective to maintain the overhead temperature of said fractionation column at a temperature whereby the major portion of said heavier hydrocarbon components is recovered in said relatively less volatile liquid fraction.

3. A process for the separation of liquefied natural gas containing methane, $C_2$ components, and heavier hydrocarbon components into a volatile liquid fraction containing a major portion of said methane and a major portion of said $C_2$ components and a relatively less volatile liquid fraction containing any remaining $C_2$ components and a major portion of said heavier hydrocarbon components wherein (a) said liquefied natural gas is heated sufficiently to at least partially vaporize said liquefied natural gas, thereby forming a vapor-containing stream;

(b) said vapor-containing stream is undivided and is expanded to lower pressure and is supplied to a fractionation column at a mid-column feed position wherein said expanded vapor-containing stream is fractionated into an overhead vapor stream and said relatively less volatile fraction containing the major portion of said heavier hydrocarbon components;

(c) a vapor distillation stream is withdrawn from a region of said fractionation column below said expanded vapor-containing stream and, in the absence of further compression, is cooled sufficiently to at least partially condense said vapor distillation stream, with said cooling supplying at least a portion of said heating of said liquefied natural gas;

(d) said partially condensed vapor distillation stream is combined with said overhead vapor stream, forming thereby a condensed stream and a residual vapor stream;

(e) at least a portion of said condensed stream is supplied to said fractionation column at a top column feed position;

(f) said residual vapor stream is compressed to higher pressure and is thereafter cooled sufficiently to at least partially condense said residual vapor stream, forming thereby said volatile liquid fraction containing a major portion of said methane and a major portion of said $C_2$ components, with said cooling supplying at least a portion of said heating of said liquefied natural gas; and (g) the quantities and temperatures of said feeds to said fractionation column are effective to maintain the overhead temperature of said fractionation column at a temperature whereby the major portion of said heavier hydrocarbon components is recovered in said relatively less volatile liquid fraction.

4. A process for the separation of liquefied natural gas containing methane, $C_2$ components, and heavier hydrocarbon components into a volatile liquid fraction containing a major portion of said methane and a major portion of said $C_2$ components and a relatively less volatile liquid fraction containing any remaining $C_2$ components and a major portion of said heavier hydrocarbon components wherein (a) said liquefied natural gas is heated sufficiently to at least partially vaporize said liquefied natural gas, thereby forming a vapor stream and a liquid stream;

(b) said vapor stream, which is undivided, and said liquid stream are expanded to lower pressure and are supplied to a fractionation column at upper and lower mid-column feed positions, respectively, wherein said expanded vapor stream and said expanded liquid stream are fractionated into an overhead vapor stream and said relatively less volatile fraction containing the major portion of said heavier hydrocarbon components;

(c) a vapor distillation stream is withdrawn from a region of said fractionation column below said expanded vapor stream and, in the absence of further compression, is cooled sufficiently to at least partially condense said vapor distillation stream, with said cooling supplying at least a portion of said heating of said liquefied natural gas;

(d) said partially condensed vapor distillation stream is combined with said overhead vapor stream, forming thereby a condensed stream and a residual vapor stream;

(e) at least a portion of said condensed stream is supplied to said fractionation column at a top column feed position;

(f) said residual vapor stream is compressed to higher pressure and is thereafter cooled sufficiently to at least partially condense said residual vapor stream, forming thereby said volatile liquid fraction containing a major portion of said methane and a major portion of said $C_2$ components, with said cooling supplying at least a portion of said heating of said liquefied natural gas; and (g) the quantities and temperatures of said feeds to said fractionation column are effective to maintain the overhead temperature of said fractionation column at a temperature whereby the major portion of said heavier hydrocarbon components is recovered in said relatively less volatile liquid fraction.

5. The process according to claim 1 wherein said vapor-containing stream is expanded to lower pressure and said expanded vapor-containing stream, which is undivided, is thereafter supplied to said fractionation column at said mid-column feed position.

6. The process according to claim 2 wherein said vapor stream and said liquid stream are expanded to lower pressure and said expanded vapor stream, which is undivided, and said expanded liquid stream are thereafter supplied to said fractionation column at said upper and lower mid-column feed positions, respectively.

7. The process according to claim 1, 2, 3, 4, 5, or 6 wherein (a) said condensed stream is divided into at least a first liquid stream and a second liquid stream;

(b) said first liquid stream is supplied to said fractionation column at said top feed position; and (c) said second liquid stream is supplied to said fractionation column at a mid-column feed location in substantially the same region wherein said vapor distillation stream is withdrawn.

8. The process according to claim 1, 2, 3, 4, 5, or 6 wherein a liquid distillation stream is withdrawn from said fractionation column at a location above the region wherein said vapor distillation stream is withdrawn, whereupon said liquid distillation stream is thereafter redirected into said fractionation column at a location below the region wherein said vapor distillation stream is withdrawn.

9. The process according to claim 7 wherein a liquid distillation stream is withdrawn from said fractionation column at a location above the region wherein said vapor distillation stream is withdrawn, whereupon said liquid distillation stream is thereafter redirected into said fractionation column at a location below the region wherein said vapor distillation stream is withdrawn.

10. The process according to claim 8 wherein said liquid distillation stream is heated and said heated liquid distillation stream is thereafter redirected into said fractionation column at said location below the region wherein said vapor distillation stream is withdrawn.

11. The process according to claim 9 wherein said liquid distillation stream is heated and said heated liquid distillation stream is thereafter redirected into said fractionation column at said location below the region wherein said vapor distillation stream is withdrawn.

12. An apparatus for the separation of liquefied natural gas containing methane, $C_2$ components, and heavier hydrocarbon components into a volatile vapor fraction containing a major portion of said methane and a major portion of said $C_2$ components and a relatively less volatile liquid fraction containing any remaining $C_2$ components and a major portion of said heavier hydrocarbon components comprising (a) heat exchange means connected to receive said liquefied natural gas and heat said liquefied natural gas sufficiently to partially vaporize said liquefied natural gas, thereby forming a vapor-containing stream;

(b) said heat exchange means further connected to a fractionation column to supply said vapor-containing stream, which is undivided, at a mid-column feed position, said fractionation column being adapted to fractionate said vapor-containing stream into an overhead vapor stream and said relatively less volatile fraction containing the major portion of said heavier hydrocarbon components;

(c) vapor withdrawing means connected to said fractionation column to receive a vapor distillation stream from a region of said fractionation column below said vapor-containing stream;

(d) said heat exchange means further connected to said withdrawing means to receive said vapor distillation stream and, in the absence of further compression, to cool said vapor distillation stream sufficiently to at least partially condense said vapor distillation stream, with said cooling supplying at least a portion of said heating of said liquefied natural gas;

(e) separation means connected to said heat exchange means to receive said at least partially condensed vapor distillation stream and separate said at least partially condensed vapor distillation stream into a condensed steam and any residual vapor stream;

(f) said separation means further connected to said fractionation column to supply at least a portion of said condensed stream to said fractionation column at a top column feed position;

(g) combining means connected to said fractionation column and said separation means to receive said overhead vapor stream and said residual vapor stream, thereby forming said volatile vapor fraction containing a major portion of said methane and a major portion of said $C_2$ components; and (h) control means adapted to regulate the quantities and temperatures of said feed streams to said fractionation column to maintain the overhead temperature of said fractionation column at a temperature whereby the major portion of said heavier hydrocarbon components is recovered in said relatively less volatile liquid fraction.

13. An apparatus for the separation of liquefied natural gas containing methane, $C_2$ components, and heavier hydrocarbon components into a volatile vapor fraction containing a major portion of said methane and a major portion of said $C_2$ components and a relatively less volatile liquid fraction containing any remaining $C_2$ components and a major portion of said heavier hydrocarbon components comprising (a) heat exchange means connected to receive said liquefied natural gas and heat said liquefied natural gas sufficiently to partially vaporize said liquefied natural gas;

(b) first separation means connected to said heat exchange means to receive said heated partially vaporized liquefied natural gas and separate said heated partially vaporized liquefied natural gas into a vapor stream and a liquid stream;

(c) said first separation means further connected to a fractionation column to supply said vapor stream, which is undivided, and said liquid stream at upper and lower mid-column feed positions, respectively, said fractionation column being adapted to fractionate said vapor stream and said liquid stream into an overhead vapor stream and said relatively less volatile fraction containing the major portion of said heavier hydrocarbon components;

(d) vapor withdrawing means connected to said fractionation column to receive a vapor distillation stream from a region of said fractionation column below said vapor stream;

(e) said heat exchange means further connected to said withdrawing means to receive said vapor distillation stream and, in the absence of further compression, to cool said vapor distillation stream sufficiently to at least partially condense said vapor distillation stream, with said cooling supplying at least a portion of said heating of said liquefied natural gas;

(f) second separation means connected to said heat exchange means to receive said at least partially condensed vapor distillation stream and separate said at least partially condensed vapor distillation stream into a condensed steam and any residual vapor stream;

(g) said second separation means further connected to said fractionation column to supply at least a portion of said condensed stream to said fractionation column at a top column feed position;

(h) combining means connected to said fractionation column and said second separation means to receive said overhead vapor stream and said residual vapor stream, thereby forming said volatile vapor fraction containing a major portion of said methane and a major portion of said $C_2$ components; and (i) control means adapted to regulate the quantities and temperatures of said feed streams to said fractionation column to maintain the overhead temperature of said fractionation column at a temperature whereby the major portion of said heavier hydrocarbon components is recovered in said relatively less volatile liquid fraction.

14. An apparatus for the separation of liquefied natural gas containing methane, $C_2$ components, and heavier hydrocarbon components into a volatile liquid fraction containing a major portion of said methane and a major portion of said $C_2$ components and a relatively less volatile liquid fraction containing any remaining $C_2$ components and a major portion of said heavier hydrocarbon components comprising (a) heat exchange means connected to receive said liquefied natural gas and heat said liquefied natural gas sufficiently to partially vaporize said liquefied natural gas, thereby forming a vapor-containing stream;

(b) expansion means connected to said heat exchange means to receive said vapor-containing stream and expand said vapor-containing stream to lower pressure;

(c) said expansion means further connected to a fractionation column to supply said expanded vapor-containing stream, which is undivided, at a mid-column feed position, said fractionation column being adapted to fractionate said expanded vapor-containing stream into an overhead vapor stream and said relatively less volatile fraction containing the major portion of said heavier hydrocarbon components;

(d) vapor withdrawing means connected to said fractionation column to receive a vapor distillation stream from a region of said fractionation column below said expanded vapor-containing stream;

(e) said heat exchange means further connected to said withdrawing means to receive said vapor distillation stream and, in the absence of further compression, to cool said vapor distillation stream sufficiently to at least partially condense said vapor distillation stream, with said cooling supplying at least a portion of said heating of said liquefied natural gas;

(f) combining means connected to said fractionation column and said heat exchange means to receive said overhead vapor stream and said at least partially condensed vapor distillation stream, thereby forming a combined stream;

(g) separation means connected to said combining means to receive said combined stream and separate said combined stream into a condensed steam and a residual vapor stream;

(h) said separation means further connected to said fractionation column to supply at least a portion of said condensed stream to said fractionation column at a top column feed position;

(i) compressing means connected to said separation means to receive said residual vapor stream and compress said residual vapor stream to higher pressure;

(j) said heat exchange means further connected to said compressing means to receive said compressed residual vapor stream and cool said compressed residual vapor stream sufficiently to at least partially condense said compressed residual vapor stream, thereby forming said volatile liquid fraction containing a major portion of said methane and a major portion of said $C_2$ components, with said cooling supplying at least a portion of said heating of said liquefied natural gas; and (k) control means adapted to regulate the quantities and temperatures of said feed streams to said fractionation column to maintain the overhead temperature of said fractionation column at a temperature whereby the major portion of said heavier hydrocarbon components is recovered in said relatively less volatile liquid fraction.

15. An apparatus for the separation of liquefied natural gas containing methane, $C_2$ components, and heavier hydrocarbon components into a volatile liquid fraction containing a major portion of said methane and a major portion of said $C_2$ components and a relatively less volatile liquid fraction containing any remaining $C_2$ components and a major portion of said heavier hydrocarbon components comprising (a) heat exchange means connected to receive said liquefied natural gas and heat said liquefied natural gas sufficiently to partially vaporize said liquefied natural gas;

(b) first separation means connected to said heat exchange means to receive said heated partially vaporized liquefied natural gas and separate said heated partially vaporized liquefied natural gas into a vapor stream and a liquid stream;

(c) first expansion means connected to said first separation means to receive said vapor stream and expand said vapor stream to lower pressure;

(d) second expansion means connected to said first separation means to receive said liquid stream and expand said liquid stream to lower pressure;

(e) said first expansion means and said second expansion means further connected to a fractionation column to supply said expanded vapor stream, which is undivided, and said expanded liquid stream at upper and lower mid-column feed positions, respectively, said fractionation column being adapted to fractionate said expanded vapor stream and said expanded liquid stream into an overhead vapor stream and said relatively less volatile fraction containing the major portion of said heavier hydrocarbon components;

(f) vapor withdrawing means connected to said fractionation column to receive a vapor distillation stream from a region of said fractionation column below said expanded vapor stream;

(g) said heat exchange means further connected to said withdrawing means to receive said vapor distillation stream and, in the absence of further compression, to cool said vapor distillation stream sufficiently to at least partially condense said vapor distillation stream, with said cooling supplying at least a portion of said heating of said liquefied natural gas;

(h) combining means connected to said fractionation column and said heat exchange means to receive said overhead vapor stream and said at least partially condensed vapor distillation stream, thereby forming a combined stream;

(i) second separation means connected to said combining means to receive said combined stream and separate said combined stream into a condensed steam and a residual vapor stream;

(j) said second separation means further connected to said fractionation column to supply at least a portion of said condensed stream to said fractionation column at a top column feed position;

(k) compressing means connected to said second separation means to receive said residual vapor stream and compress said residual vapor stream to higher pressure;

(l) said heat exchange means further connected to said compressing means to receive said compressed residual vapor stream and cool said compressed residual vapor stream sufficiently to at least partially condense said compressed residual vapor stream, thereby forming said volatile liquid fraction containing a major portion of said methane and a major portion of said $C_2$ components, with said cooling supplying at least a portion of said heating of said liquefied natural gas; and (m) control means adapted to regulate the quantities and temperatures of said feed streams to said fractionation column to maintain the overhead temperature of said fractionation column at a temperature whereby the major portion of said heavier hydrocarbon components is recovered in said relatively less volatile liquid fraction.

16. The apparatus according to claim 12 wherein an expansion means is connected to said heat exchange means to receive said vapor-containing stream, which is undivided, and expand said vapor-containing stream to lower pressure, said expansion means being further connected to said fractionation column to supply said expanded vapor-containing stream at said mid-column feed position.

17. The apparatus according to claim 13 wherein (a) a first expansion means is connected to said first separation means to receive said vapor stream and expand said vapor stream to lower pressure;

(b) a second expansion means is connected to said first separation means to receive said liquid stream and expand said liquid stream to said lower pressure; and (c) said first expansion means and said second expansion means are further connected to said fractionation column to supply said expanded vapor stream, which is undivided, and said expanded liquid stream at said upper and lower mid-column feed positions, respectively.

18. The apparatus according to claim 12, 14, or 16 wherein (a) a dividing means is connected to said separation means to receive said condensed stream and divide said condensed stream into at least first and second liquid streams, said dividing means being further connected to said fractionation column to supply said first liquid stream to said distillation column at said top feed position; and (b) said dividing means is further connected to said fractionation column to supply said second liquid stream to said fractionation column at a location in substantially the same region as said vapor withdrawing means.

19. The apparatus according to claim 13, 15, or 17 wherein (a) a dividing means is connected to said second separation means to receive said condensed stream and divide said condensed stream into at least first and second liquid streams, said dividing means being further connected to said fractionation column to supply said first liquid stream to said distillation column at said top feed position; and (b) said dividing means is further connected to said fractionation column to supply said second liquid stream to said fractionation column at a location in substantially the same region as said vapor withdrawing means.

20. The apparatus according to claim 12, 13, 14, 15, 16, or 17 wherein a liquid withdrawing means is connected to said fractionation column to receive a liquid distillation stream from a region of said fractionation column above that of said vapor withdrawing means, said liquid withdrawing means being further connected to said fractionation column to supply said liquid distillation stream to said fractionation column at a location below that of said vapor withdrawing means.

21. The apparatus according to claim 18 wherein a liquid withdrawing means is connected to said fractionation column to receive a liquid distillation stream from a region of said fractionation column above that of said vapor withdrawing means, said liquid withdrawing means being further connected to said fractionation column to supply said liquid distillation stream to said fractionation column at a location below that of said vapor withdrawing means.

22. The apparatus according to claim 19 wherein a liquid withdrawing means is connected to said fractionation column to receive a liquid distillation stream from a region of said fractionation column above that of said vapor withdrawing means, said liquid withdrawing means being further connected to said fractionation column to supply said liquid distillation stream to said fractionation column at a location below that of said vapor withdrawing means.

23. The apparatus according to claim 20 wherein a heating means is connected to said liquid withdrawing means to receive said liquid distillation stream and heat said liquid distillation stream, said heating means being further connected to said fractionation column to supply said heated liquid distillation stream to said fractionation column at said location below that of said vapor withdrawing means.

24. The apparatus according to claim 21 wherein a heating means is connected to said liquid withdrawing means to receive said liquid distillation stream and heat said liquid distillation stream, said heating means being further connected to said fractionation column to supply said heated liquid distillation stream to said fractionation column at said location below that of said vapor withdrawing means.

25. The apparatus according to claim 22 wherein a heating means is connected to said liquid withdrawing means to receive said liquid distillation stream and heat said liquid distillation stream, said heating means being further connected to said fractionation column to supply said heated liquid distillation stream to said fractionation column at said location below that of said vapor withdrawing means.

* * * * *